US005484100A

United States Patent [19]

Rigby

[11] Patent Number: 5,484,100

[45] Date of Patent: Jan. 16, 1996

[54] TAPERED, HEXAGONAL PAPERBOARD CARTON

[75] Inventor: William R. Rigby, Newark, Del.

[73] Assignee: Westvaco Corporation, New York, N.Y.

[21] Appl. No.: 427,669

[22] Filed: Mar. 24, 1995

[51] Int. Cl.[6] ..... B65D 5/355

[52] U.S. Cl. ..... 229/101.1; 229/110; 229/114; 229/117

[58] Field of Search ..... 229/101.1, 101.2, 229/109, 110, 114, 117

[56] References Cited

U.S. PATENT DOCUMENTS

| | | | |
|---|---|---|---|
| 1,502,864 | 7/1924 | Milligan | 229/101.1 |
| 1,792,370 | 2/1931 | Goodman | 229/110 |
| 1,932,169 | 10/1933 | Allen et al. | 229/101.1 |
| 2,085,238 | 6/1937 | Towell | 229/110 |
| 2,114,492 | 4/1938 | Horr | 229/110 |
| 2,145,430 | 1/1939 | New | 229/101.1 |
| 2,271,962 | 2/1942 | Weiner . | |
| 3,128,031 | 4/1964 | Dembo | 229/101.1 |
| 3,726,469 | 4/1973 | Koehler . | |
| 4,264,031 | 4/1981 | Goebel | 229/110 |
| 4,313,556 | 2/1982 | Boyle et al. . | |
| 4,362,266 | 12/1982 | Webinger . | |
| 4,948,035 | 8/1990 | Wischoff | 229/110 |
| 5,042,666 | 8/1991 | Dolenc | 229/101.1 |
| 5,084,284 | 1/1992 | McDilda et al. . | |
| 5,205,479 | 4/1993 | Rice et al. . | |
| 5,209,391 | 5/1993 | Krautsack . | |
| 5,251,809 | 10/1993 | Drummond et al. . | |
| 5,253,802 | 10/1993 | Bernard et al. . | |
| 5,326,023 | 7/1994 | Rice et al. . | |

FOREIGN PATENT DOCUMENTS

| | | | |
|---|---|---|---|
| 2665882 | 2/1992 | France | 229/101.1 |

*Primary Examiner*—Gary E. Elkins
*Attorney, Agent, or Firm*—J. R. McDaniel; R. L. Schmalz

[57] ABSTRACT

This invention relates to a hexagonal paperboard carton that is tapered with an automatic bottom. Such structures of this type, generally, provide a peeling feature that allows the consumer to remove the carton from the product in a continual, spiral strip.

9 Claims, 2 Drawing Sheets

TAPERED, HEXAGONAL PAPERBOARD CARTON

BACKGROUND OF THE INVENTION

1. Field of the Invention

This invention relates to a hexagonal paperboard carton that is tapered with an automatic bottom. Such structures of this type, generally, provide a peeling feature that allows the consumer to remove the carton from the product in a continual, spiral strip.

2. Description of the Related Art

It is known, in refrigerated dough product containers, to make use of a container that pops open along a spiral seam running the length of the carton. Exemplary of such prior art is U.S. Pat. No. 5,326,023 ('023) to Rice et al., entitled "Dough Container with Pre-weaken Non-Peel Label". While these prior art refrigerated dough containers adequately retain the product within the container, these containers are based upon a spiral wound canister containing partial depth cuts or overlapping seams that are held together by an outer wrapper. A more advantageous container, however, would be presented if the spiral cuts were actually 100% cuts in a parallel, offset perforated configuration which allowed the package to be torn in a spiral, rather than popped open to reach all the product at once.

It is also known in the prior art to make use of locking trays. Exemplary of such prior art is U.S. Pat. No. 4,362,266 ('266) to G. P. Webinger, entitled "Non-Glued Paper Tray". While the '266 patent teaches the use of a hexagonal tray which is tapered, the tray in the '266 patent is constructed by folding a double side wall over to lock the double side wall into the bottom of the tray and hold the adjoining sidewall vertical. This type of tray is commonly referred to as a walker lock tray. Consequently, a further advantageous carton would be one which is tapered but again, provides 100% cuts in a parallel, offset perforated configuration which allows the package to be torn in a spiral.

Finally, it is known in the prior art to make use of hexagonal packages. Exemplary of such prior art is U.S. Pat. No. 2,271,962 ('962) to D. Weiner, entitled "Box". While the '962 patent shows the hexagonal package, the hexagonal package is not tapered. One of the main reasons the carton is not tapered is that its design is based on having the carton essentially folded in half along a middle score line of the bottom panel and then glued on the two perpendicular outside edges, thereby connecting the two halves of the package. It is important in the '962 patent that the glue line must be perpendicular to the bottom fold for the package to function. Consequently, a still further advantageous carton will be one in which the glue flap is tapered to a great enough angle to allow the glue to start close to the main body of the carton and then angle out away from the main body.

It is apparent from the above that there exists a need in the art for a paperboard carton which allows the package to be torn in a spiral, and which is formed in a shape of a hexagon, but is tapered. It is the purpose of this invention to fulfill this and other needs in the art in a manner more apparent to the skilled artisan once given the following disclosure.

SUMMARY OF THE INVENTION

Generally speaking, this invention fulfills these needs by providing a tapered, hexagonal paperboard container, comprising at least two paperboard bottom panels means located a predetermined distance away from each other, at least six paperboard side panel means operatively connected to each other to form a tapered, hexagonal container and such that two of said side panel means are operatively connected to said at least two paperboard bottom panel means, and perforations located in said side panel means such that said perforations are formed in a spiral configuration along a first direction of said side panel means.

In certain preferred embodiments, the bottom panel means include an inside bottom panel and an outside bottom panel. Also, the side panel means includes a glue flap. Finally, the perforations are double perforations which are 100% cuts in a parallel, offset configuration.

In another further preferred embodiment, the hexagonal carton is tapered with an automatic bottom and has a peeling feature that allows the consumer to remove the carton from the product in a continual, spiral strip.

The preferred tapered paperboard carton, according to this invention, offers the following advantages: lightness in weight; ease of assembly; excellent peeling characteristics; excellent stability; good durability; good printability; and excellent economy. In fact, in many of the preferred embodiments, these factors of ease of assembly, peeling characteristics and stability are optimized to an extent that is considerably higher than heretofore achieved in prior, known paperboard cartons.

The above and other features of the present invention, which will become more apparent as the description proceeds, are best understood by considering the following detailed description in conjunction with the accompanying drawings, wherein like characters represent like parts throughout the several views and in which:

DETAILED DESCRIPTION OF THE INVENTION

Figure 1:
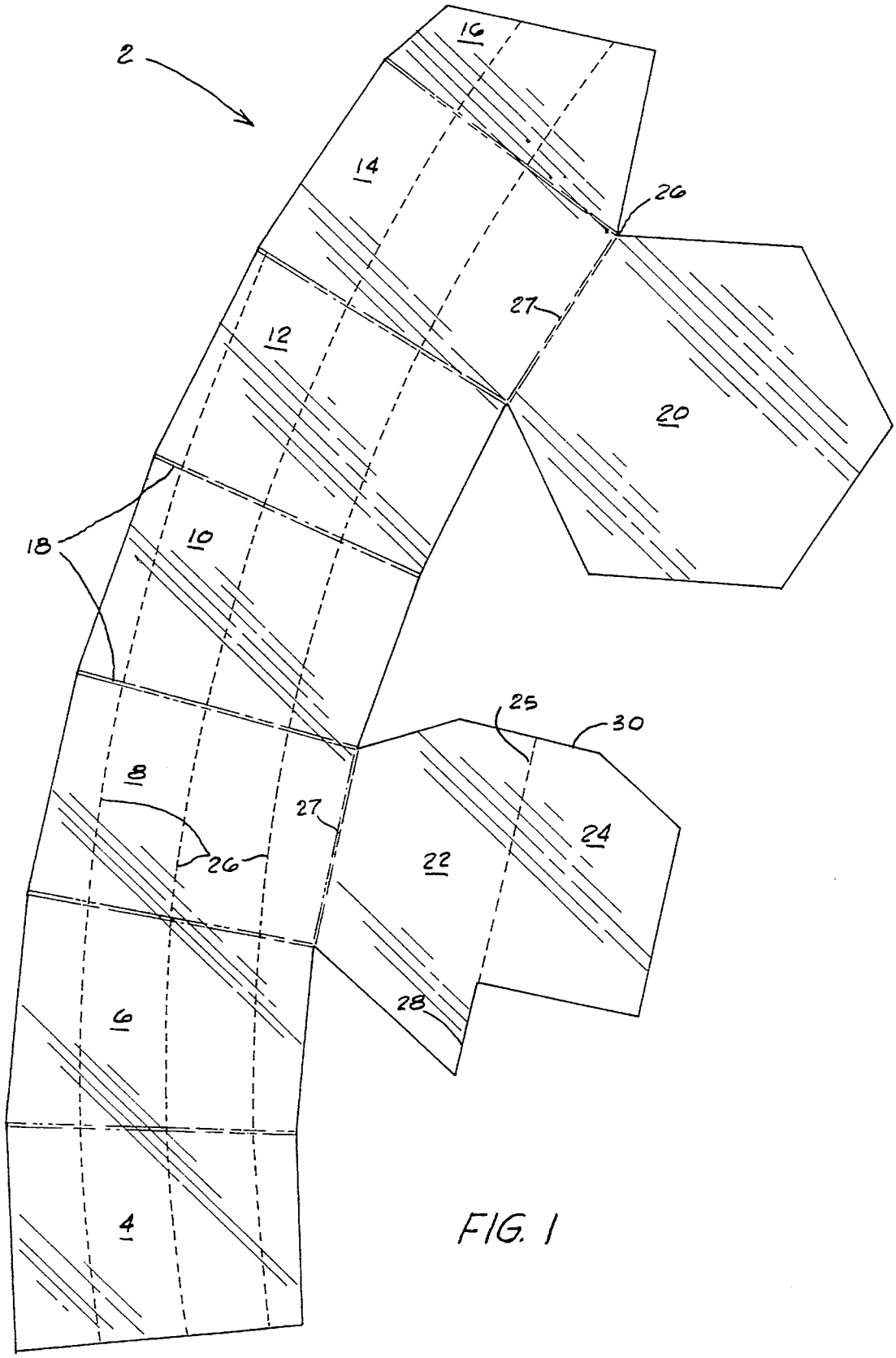
FIG. 1 is a plan view of a hexagonal paperboard carton blank, according to the present invention.
Figure 2:
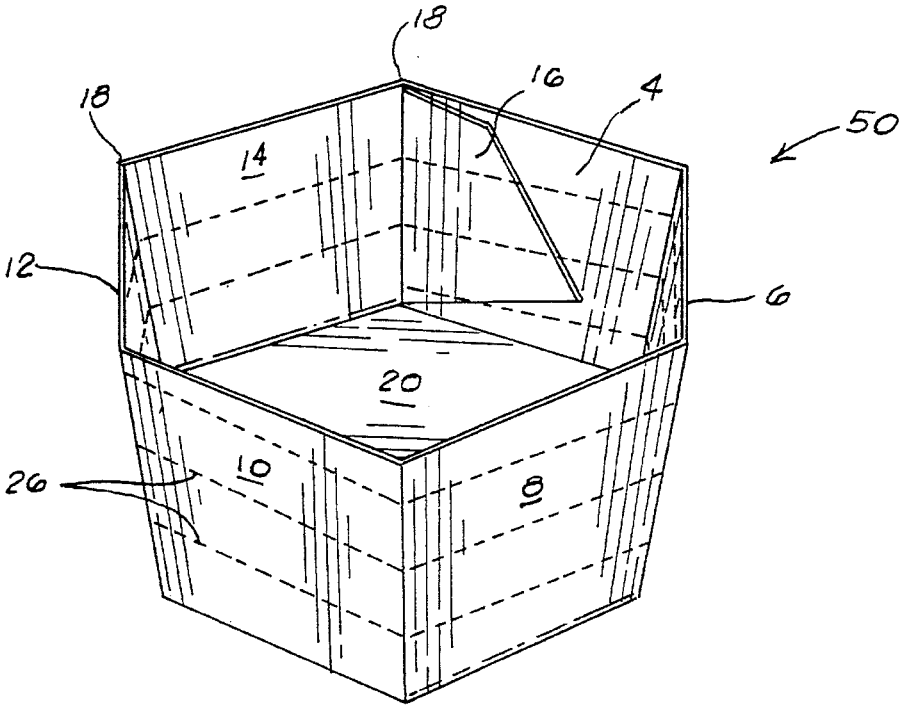
FIG. 2 is an isometric view of a constructed tapered, hexagonal paperboard carton, according to the present invention.

With reference first to FIG. 1, there is illustrated a paperboard blank 2 which is used for constructing a tapered, hexagonal paperboard carton 50 (FIG. 2). The basic substrate material for the present invention is machine-made paperboard which may range from 0.007 to 0.035 inches in thickness. In some cases, it may be desirable to coat the paperboard web stock with a film of extruded or press applied polymer, on that web side to be formed to the container interior, selected on the basis of chemical and adhesive receptivity.

Furthermore, those of ordinary skill in the art understand the economic value to consumer packaging arising from the quality of graphics that may be press applied to a clay coated paperboard web. Accordingly, display shelf graphics may be directly applied to the exterior surface of the container wall that is opposite the interior surface in direct contact with the package contents. Thus, no outer packaging or post-filled labeling is required. Moreover, the web may be printed and dye cut into individual container blanks in one continuous machine fed operation.

Returning to blank 2, blank 2 includes in part, six side panels (4–14), glue flap 16, score lines 18, inside bottom panel 20, outside bottom panels 22 and 24, score lines 25 and 27, spiraled, double perforations 26 in side panels 4–14, and outside edges 28 and 30.

Figure 3:
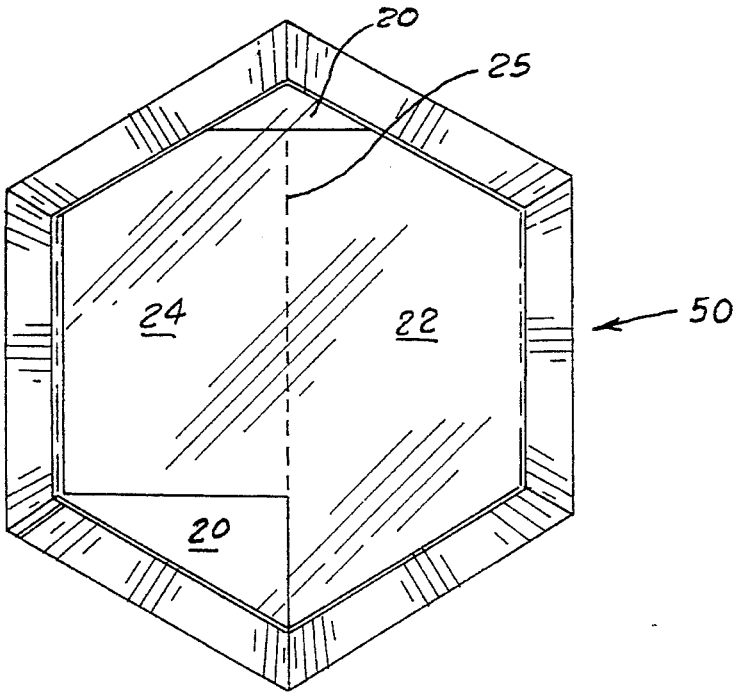
FIG. 3 is a bottom view of the constructed tapered, hexagonal paperboard carton, according to the present invention.

FIGS. 2 and 3 illustrate a constructed, hexagonal, tapered paperboard carton 50. As can be seen, in this constructed configuration, inside bottom panel 20 is pulled into place by outside bottom panels 22 and 24 (FIG. 3). This is because inside bottom panel 20 is glued to outside bottom panel 24 with a conventional adhesive. Also, side panel 4 and glue flap 16 are adhered together by a conventional adhesive to form the hexagonal shape.

Finally, as can be seen in FIG. 2, spiraled perforations 26 allow the consumer to tear the paperboard material along the spirals 26 in order to expose the food contents (not shown) within the container 50 as the food contents are being consumed.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A tapered, hexagonal paperboard container, wherein said composite package comprised of:

at least two paperboard bottom panels;

at least six paperboard side panels hingedly connected to each other to form a tapered, hexagonal container wherein two of said side panels are hingedly connected to said at least two paperboard bottom panels; and perforations located on said side panels wherein said perforations are formed in a spiral configuration along a first direction of said side panels.

2. The container, as in claim 1, wherein said bottom panels is further comprised of:

an inside bottom panel; and an outside bottom panel having first and second sections hingedly connected to each other wherein said second section is rigidly attached to said inside bottom panel.

3. The container, as in claim 1, wherein said container is further comprised of:

a flap hingedly attached to one of said side panels and rigidly attached to another of said side panels.

4. The container, as in claim 1, wherein said perforations are further comprised of:

100% cuts in a parallel, offset configuration.

5. The container, as in claim 1, wherein said container is further comprised of:

edges located substantially on an outside edge of said bottom panels.

6. The container, as in claim 1, wherein said bottom panels are hingedly connected to said side panels by fold score lines.

7. The container, as in claim 1, wherein said side panels are hingedly connected to each other by fold score lines.

8. The container, as in claim 2, wherein said first and second sections are hingedly connected to each other by fold score lines.

9. The container, as in claim 3, wherein said perforations are located on said flaps.

* * * * *

UNITED STATES PATENT AND TRADEMARK OFFICE

CERTIFICATE OF CORRECTION

PATENT NO. : 5,484,100

DATED : Jan. 16, 1996

INVENTOR(S) : William R. Rigby

It is certified that error appears in the above-indentified patent and that said Letters Patent is hereby corrected as shown below:

Title page, item [22] Filed: delete "Mar. 24, 1995" insert --Apr. 24, 1995--.

Signed and Sealed this

Twenty-ninth Day of October 1996

*Attest:*

*Attesting Officer*

BRUCE LEHMAN

*Commissioner of Patents and Trademarks*